US005738391A

United States Patent [19]

Chaney et al.

[11] Patent Number: 5,738,391

[45] Date of Patent: Apr. 14, 1998

[54] FULCRUM WINDOW LOCK

[75] Inventors: Michael T. Chaney, Middletown; Joseph J. Levangie, Franklin; Ray Garries, Springboro; David R. Kirchner, Camden, all of Ohio

[73] Assignee: Dayton Technologies, Inc., Monroe, Ohio

[21] Appl. No.: 685,734

[22] Filed: Jul. 24, 1996

[51] Int. Cl.[6] ..... E05C 3/06

[52] U.S. Cl. ..... 292/198; 292/202; 292/229; 292/DIG. 47

[58] Field of Search ..... 292/202, 229, 292/198, DIG. 20, DIG. 47

[56] References Cited

U.S. PATENT DOCUMENTS

| | | | |
|---|---|---|---|
| 650,521 | 5/1900 | Shaw et al. | 292/198 |
| 1,059,555 | 4/1913 | Money | 292/229 |
| 1,203,595 | 11/1916 | Evensen | 292/198 |
| 1,490,874 | 4/1924 | Webb | 292/DIG. 20 |
| 1,671,876 | 5/1928 | Stewart | 292/202 |
| 1,804,518 | 5/1931 | Shinn | 292/DIG. 20 |
| 2,079,283 | 5/1937 | Etling | 292/202 |
| 2,480,988 | 9/1949 | Walton | 292/DIG. 20 |
| 4,061,371 | 12/1977 | Prather et al. | 292/198 |
| 4,507,894 | 4/1985 | Anderson | 292/DIG. 47 |

FOREIGN PATENT DOCUMENTS

| | | | |
|---|---|---|---|
| 2028695 | 8/1971 | Germany | 292/DIG. 20 |

*Primary Examiner*—Rodney M. Lindsey
*Attorney, Agent, or Firm*—Jacox, Meckstroth & Jenkins

[57] ABSTRACT

A fulcrum lock for preventing substantial movement of a window sash when wind forces are directed against the sash. The sash includes a frame that is contained in an outer window frame. The fulcrum lock has an elongated main body provided with a fulcrum or pivot surface located between the ends of the main body, and legs that extend generally perpendicular to the extent of the main body. The fulcrum lock is located in one of the sash or window frames, while the other of said frames is provided with an opening located to receive one of the ends of the fulcrum lock when the other end is engaged by the frame containing the opening.

4 Claims, 4 Drawing Sheets

FULCRUM WINDOW LOCK

BACKGROUND OF THE INVENTION

Figure 1:
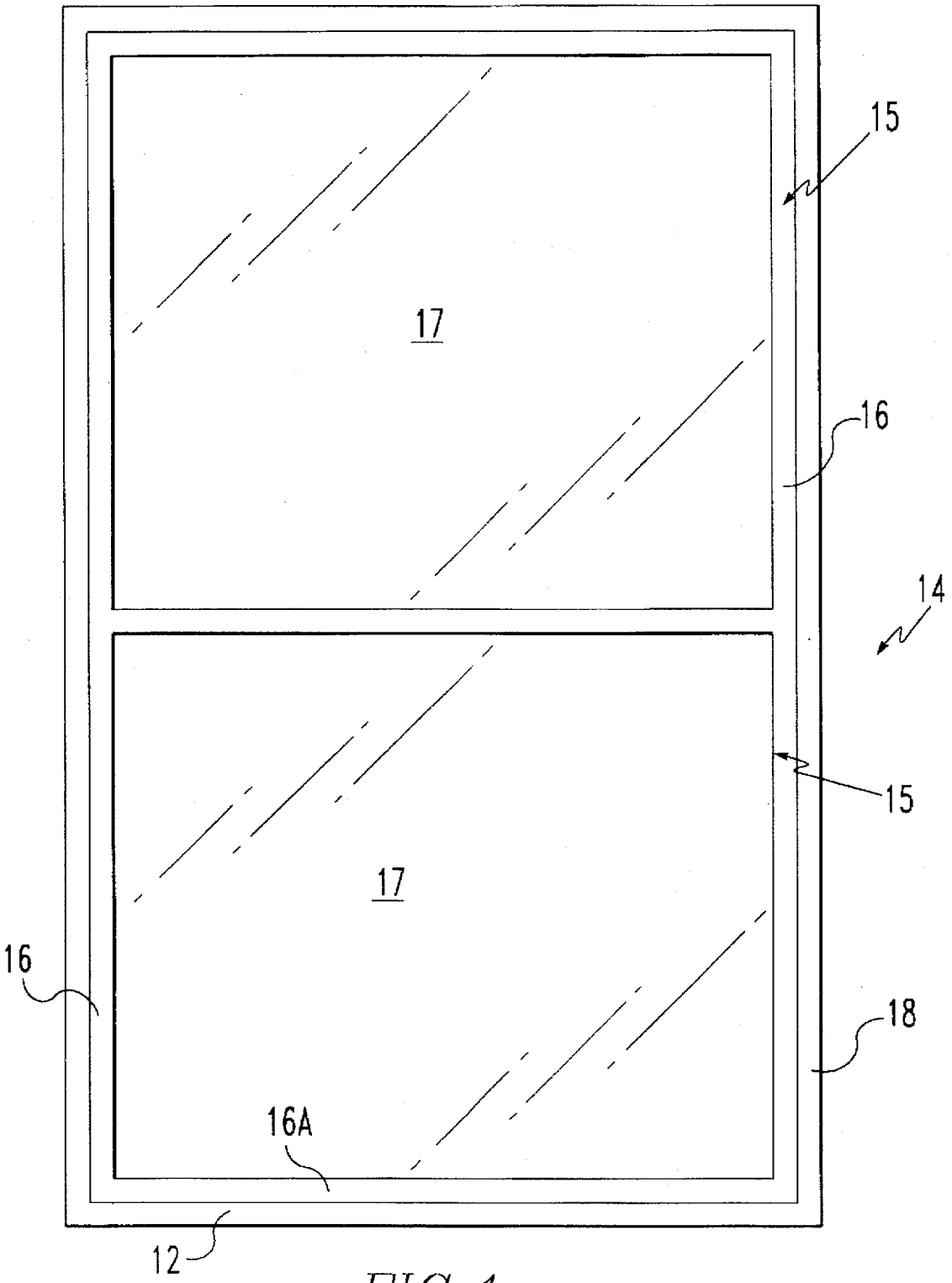

The present invention relates generally to windows and, more particularly, to securing sashes in window frames when the sash is subject to positive and negative wind loads.

The lower horizontal frame or sill of certain types of windows containing a rotatable or vertically slideable sash has a lower vertical lip or upstanding edge that is quite shallow such that when wind loads are applied against the sash, the lower frame of the sash rides over the vertical lip or edge. This is particularly true when windows are subjected to test loads using large blowers and fans that direct air streams against the windows at high velocities in a direction generally perpendicular to the planes of the windows.

The reason for the lip being shallow is to provide a maximum amount of open space to allow occupants in a building or a mobile home to climb through the opening of the window and for firemen or other service people to climb in, without breaking the window of the sash, in case of a fire or other emergency. For these reasons, any device that protrudes into the opening of a window area is generally forbidden by industry standards. For example, the problem cannot be solved by increasing the height of the lip or edge in the lower window free, or by the use of pins that protrude into the sash frame from the window frame when the sash is closed, i.e., these reduce the ingress and egress opening of window frames and therefore are generally not acceptable.

In a window frame having upper and lower sashes, only the lower frame of the lower sash is a problem since the upper frame of the lower sash and the lower frame of the upper sash overlap to provide a generally robust structure. The window frame portion containing the upper sash is not a problem since its structure is usually sufficient to hold the upper sash in place, and has the aid of the overlapping sash frame portions.

BRIEF DESCRIPTION OF THE INVENTION

Rather than reducing the size of the window opening by increasing the height of the lip of the window sill or using pins that extend into the area of an open window, the present invention uses a small simple fulcrum lock located either in the lower horizontal sill of a window or in the lower horizontal frame of a sash, which fulcrum lock has two vertically extending but shallow ends, one of which is engaged when the sash is closed against the lower horizontal frame of the window. The other end of the fulcrum lock is thereby rotated about the pivot of the fulcrum into an opening provided in the sash or window frame. This locks the sash frame in the window frame such that the sash frame cannot ride over the upstanding lip or edge of the window sill.

When the sash is raised from the window sill, the weight of the fulcrum lock on the end that entered the opening in the window or sash frame, causes that end to drop into the window or sash frame and thus remove itself from the open area of the window when the sash is in a raised, open position.

THE DRAWINGS

Figure 2:
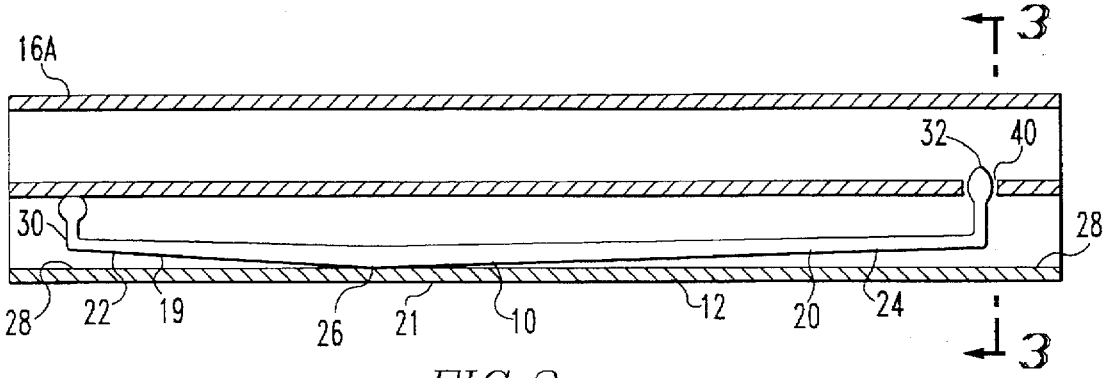
Figure 3:
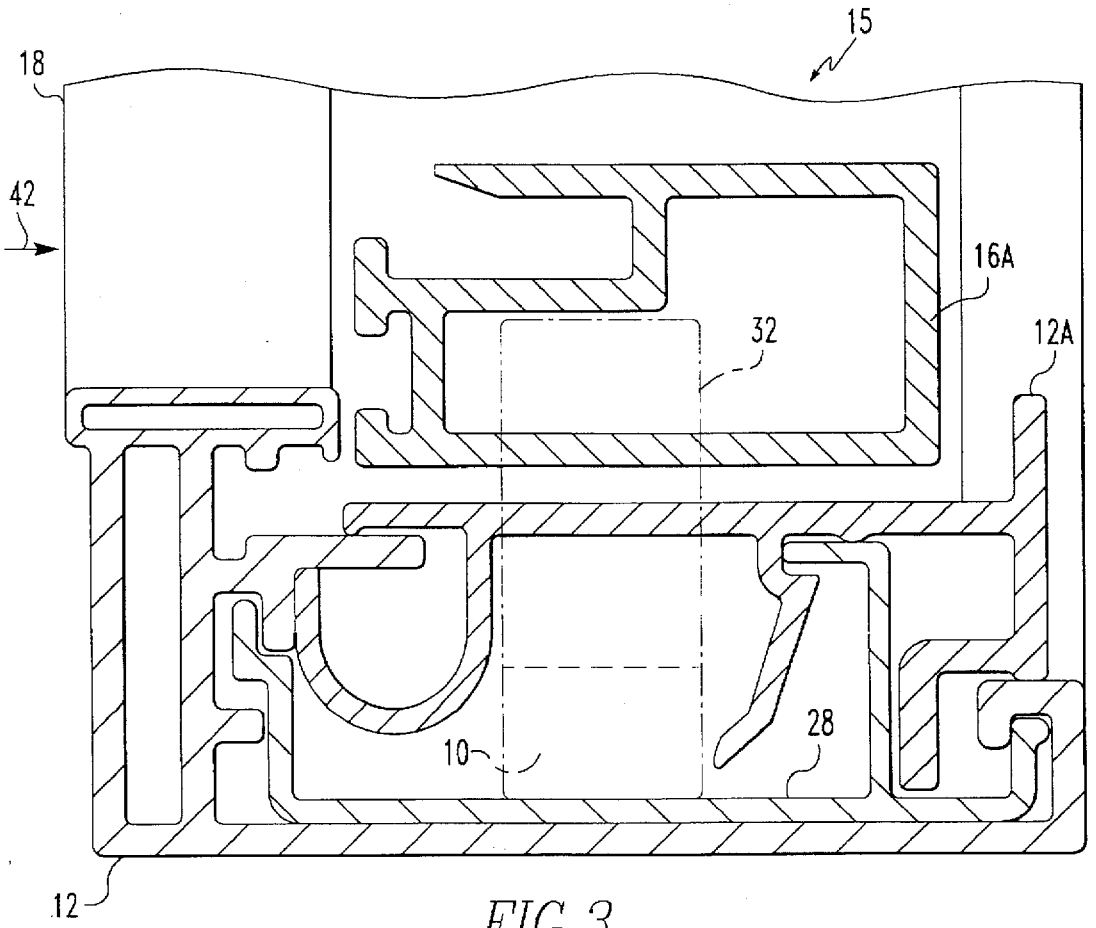
Figure 4:
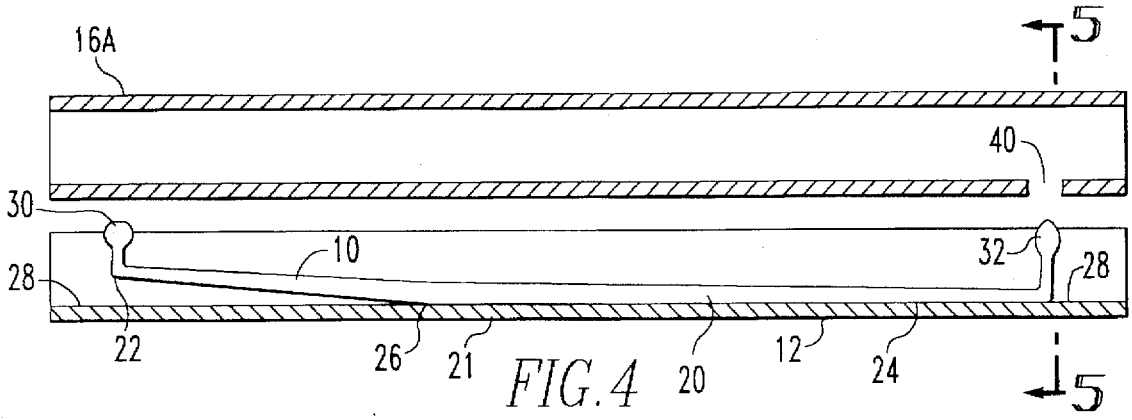
Figure 5:
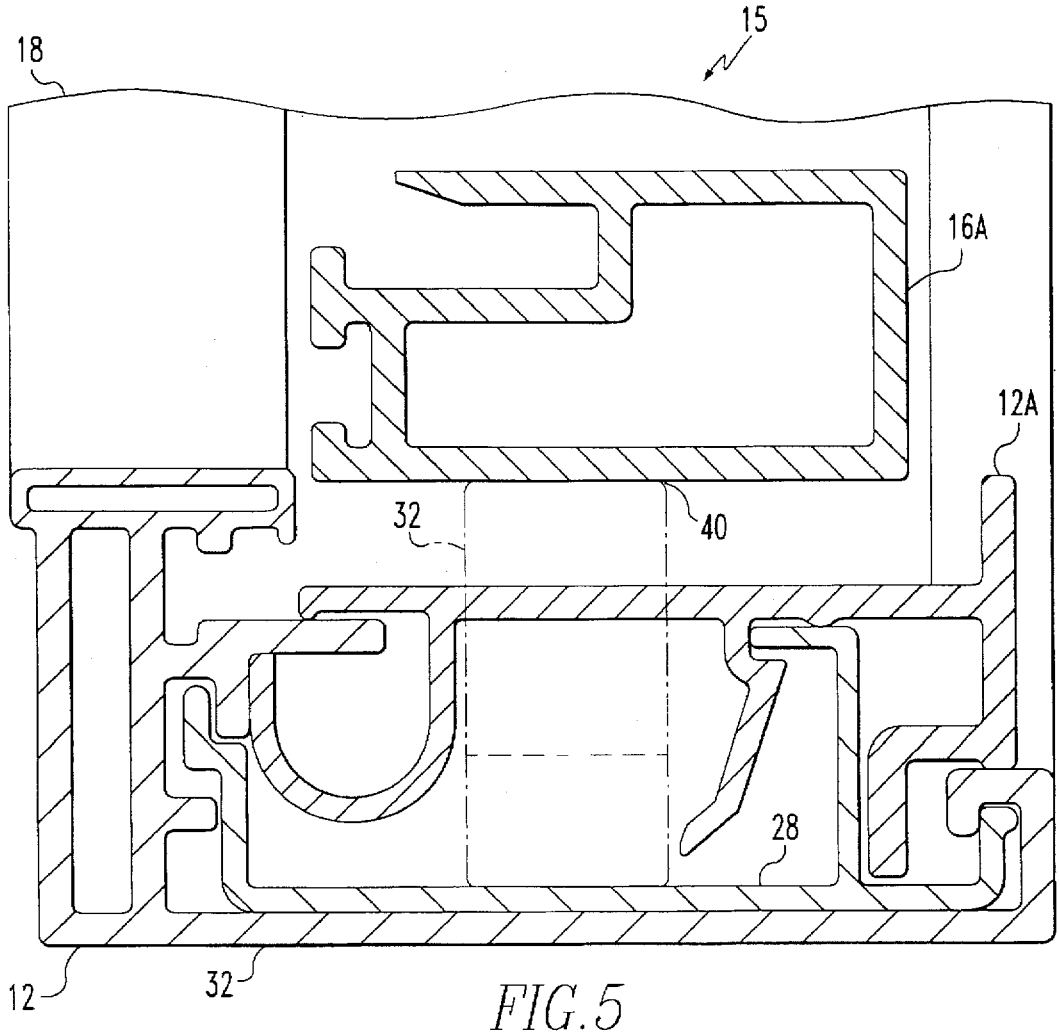
Figure 6:
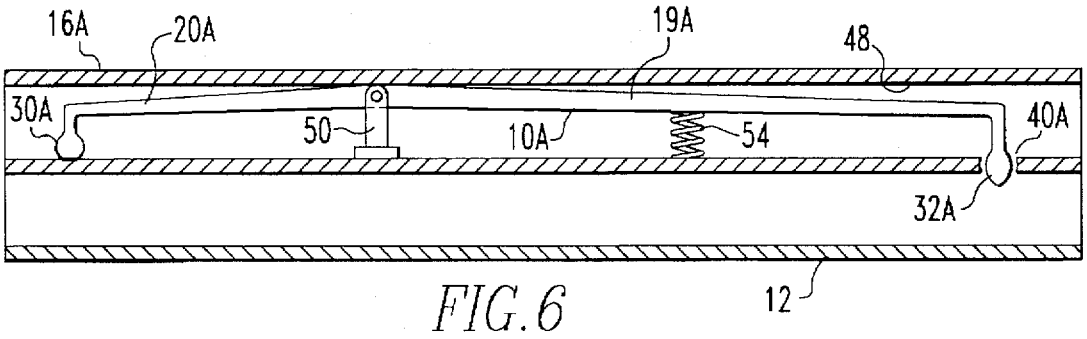
Figure 7:
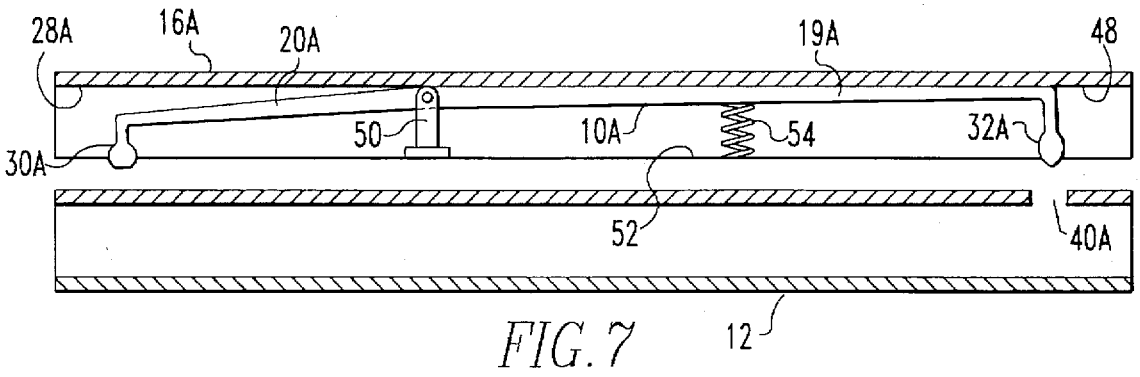

The invention, along with its advantages and objectives, will be better understood from consideration of the following detailed description and the accompanying drawings, in which:

FIG. 1 is a front elevation of a window frame containing upper and lower sashes, the window frame having a relatively shallow lower edge behind which the lower sash seats when fully closed within the window frame, FIG. 2 shows the fulcrum lock of the invention located in the lower horizontal frame or sill of the window of FIG. 1, and thus beneath the sash closed upon the lower horizontal frame, FIG. 3 is a view of the frames and fulcrum lock of FIG. 2 taken along lines 3—3 in FIG. 2, FIG. 4 shows the lower portion of the sash of FIGS. 1 and 2 raised from the horizontal sill of the window of FIGS. 1 and 2, FIG. 5 is a view of the frames and fulcrum lock of the invention taken along lines 5—5 of FIG. 4, FIG. 6 shows the fulcrum lock of the invention located in the lower frame of a sash and thus above the sill of a window frame containing the sash, and FIG. 7 shows the fulcrum lock of FIG. 5 engaged by the horizontal sill of the window.

PREFERRED EMBODIMENT

Referring now to the drawings, FIG. 2 shows the fulcrum lock 10 of the invention located in a lower hollow horizontal frame member or sill 12 of a window 14 generally depicted in FIG. 1. Window 14 includes two upper and lower sashes 15 having their own flames 16 and glass panels 17, the sash being vertically slideable or rotatable in an outer frame 18 of window 14. As shown in FIGS. 3 and 5, sill 12 can be a hollow extrusion of aluminum metal, for example, though other types of flames and materials can be used, including plastics and wood. If the frame 18 of window 14 is a solid wooden structure, frame sill 12 would have to have a hollow area or cavity to contain fulcrum lock 10.

As seen in FIGS. 3 and 5 of the drawings, window sill 12 has a shallow upstanding lip or edge 12A. It is shallow for the reasons given above. Sash frame 16A may move over edge 12A if subjected to substantial wind loads.

Fulcrum lock 10 has an elongated main body portion comprised of two opposed tapered extensions or arms 19 and 20, the taper of each arm having an integral relatively thick portion 21 near but not at the axial or longitudinal center of the main body portion, i.e., arm 20 is longer than arm 19. The arms taper to relatively narrow end portions 22 and 24, while thick portion 21 has a mildly pointed or curved pivotal surface 26 that rests on an interior, upwardly facing surface 28 of sill 12 in the embodiment of FIGS. 2 through 5. Thus, arms 19 and 20 taper upwardly and away from surface 28. Surface 26 provides a fulcrum or pivot location about which the main body and arms of the fulcrum can rotate.

The ends 22 and 24 of fulcrum lock 10 include integral leg portions 30 and 32, in FIGS. 2 through 5, the axes of which are generally perpendicular to the axis of the main body and arms 19 and 20 of the fulcrum lock.

As depicted in FIGS. 1 to 3 of the drawings, lower sash 15 is located in a downward-most position such that its lower frame portion 16A engages sill 12 and upstanding leg 30 (on the left in FIG. 2) of fulcrum 10. When the sash engages leg 30 and continues downwardly to sill 12, as fulcrum 10 rotates about its pivot surface 26 resting on sill surface 28. This rotates leg 32 of the fulcrum upwardly and into an opening 40 provided in the bottom surface of sash frame 16A. (An end elevation view of leg 32 extending into sash frame 16 is shown in FIG. 3 .) This locks sash frame 16A to window sill 12 such that when a wind load is applied to sash 15, as indicated generally by arrow 42 in FIG. 2, the sash will not ride above shallow sill edge 12A. The load against the window on the arrow side in FIG. 2 is, of course, positive, while the load on the other side is negative. If the direction of the load is reversed, the lock is still sufficient to hold the lower sash frame in place.

When sash 15 is raised from sill 12, and thus from the upstanding leg 30 of fulcrum 10, the weight or mass of the longer arm 20 of the fulcrum rotates about 26 under force of gravity to remove upstanding leg 32 from the opening 40 in sash frame 16A. The longer arm now rests on the inner surface 28 of the sill. This is shown in FIGS. 4 and 5. When this occurs, upstanding leg 30 does not enter the open space in window frame 18 left by the raised sash, as 30 is a relatively short leg, as seen in FIGS. 2 and 4. Leg 32 is longer than leg 30 but when rotated downwardly in sill 12, in the manner of FIGS. 4 and 5, does not protrude into the open area of the window.

FIGS. 6 and 7 of the drawing are sectional views of fulcrum lock 10A located in the lower hollow horizontal frame 16A of lower sash 15. The fulcrum lock is supported adjacent an upper surface 48 of hollow frame 16A by a pedestal 50 that permits the fulcrum lock to pivot about the pedestal when the sash is raised from and lowered to sill 12. The pedestal is mounted on a surface 52 (FIG. 7) in the sash frame and is pivotally attached to the fulcrum at the pivot surface 26 of the fulcrum. A spring 54 is located between arm 19A of the fulcrum and lower surface 52 in hollow frame 16A. When the lower sash is raised from sill 12, spring 54 rotates the fulcrum about pedestal 50 to remove extension 32A from an opening 40A provided in the sill. When the sash is lowered to the sill, arm 30A engages the sill to rotate arm 32A into opening 40A.

Hence, the operation of the fulcrum is similar to that described above except that vertical legs 30 and 32 face in a downwardly direction (and are designated 30A and 32A), and sill 12 is provided with an opening 40A to receive leg 32A when the lower sash and leg 30A engages the sill (FIG. 6). When the sash is raised from sill 12 (FIG. 7), horizontal arm 20A of the fulcrum rotates downwardly in sash frame 16A, thereby raising leg 32A into frame 16A so that leg 32A does not protrude into the open space in window frame 18 provided by the raised sash. Similarly, leg 30A does not extend substantially into the open space of the window, as the fulcrum itself is a shallow structure, with downward rotation of arm 20A (and leg 30A) being limited by arm 19A engaging surface 48 in the sash frame, as shown in FIG. 7. In this manner, such open space remains free of items extending into the space, thereby providing room for ingress/egress of persons and equipment into and from the structure containing the window.

What is claimed is:

1. In combination, an outer window frame, a window sash including a frame mounted in said outer frame, said outer frame having a lower sill, and a fulcrum lock for preventing substantial movement of the window sash in the outer frame when wind forces are directed against the sash, said fulcrum lock having an elongated main body portion provided with a fulcrum surface on a side thereof and on which the lock pivots, located between ends of the main body portion and with each of said ends including a leg extending generally perpendicular to the main body portion from a side of the main body portion opposite that on which the fulcrum surface is located, said fulcrum lock being located in one of the sash or outer window frame, with one of the legs projecting to engage a surface of the other of the sash or outer frame, the other of said sash or outer flame is also provided with an opening located to receive the other of the legs of the fulcrum lock when the one leg is engaged by the surface of the sash or outer frame containing the opening.

2. The fulcrum lock of claim 1 wherein the fulcrum surface of the lock is located closer to one end of the main body portion than the other end such that the one end of the main body portion is lighter in weight than the other end.

3. The fulcrum lock of claim 1 wherein said lock is located in the sill of the outer window frame, while the opening for receiving the one end of the fulcrum lock is located in a lower horizontal portion of the sash frame.

4. The fulcrum lock of claim 1 wherein said lock is located in a lower horizontal portion of the sash frame, while the opening for receiving the one end of the fulcrum lock is located in the sill of the outer window frame.

* * * * *